US008529384B2

(12) United States Patent
Corlett et al.

(10) Patent No.: US 8,529,384 B2
(45) Date of Patent: Sep. 10, 2013

(54) MARKER TAG DARTS, DART GUNS THEREFOR, AND METHODS

(75) Inventors: Richard Jonathan Corlett, Woodland Hills, CA (US); David B. Small, San Jose, CA (US); Paul S. Rago, Danville, CA (US)

(73) Assignee: Shoot the Moon Products II, LLC, Pleasanton, CA (US)

( * ) Notice: Subject to any disclaimer, the term of this patent is extended or adjusted under 35 U.S.C. 154(b) by 226 days.

(21) Appl. No.: 13/035,564

(22) Filed: Feb. 25, 2011

(65) Prior Publication Data

US 2012/0220190 A1 Aug. 30, 2012

(51) Int. Cl.
*F42B 6/00* (2006.01)
*F42B 8/00* (2006.01)
*F41B 7/08* (2006.01)

(52) U.S. Cl.
CPC .. *F42B 6/003* (2013.01); *F42B 6/00* (2013.01)
USPC ..... 473/581; 446/473; 473/578; 473/582; 124/1

(58) Field of Classification Search
CPC ..... F42B 6/00; F42B 6/003
USPC ..... 446/473; 473/578, 581, 582; 124/1
See application file for complete search history.

(56) References Cited

U.S. PATENT DOCUMENTS 3,190,654 A * 6/1965 Ross ..... 273/378
3,330,561 A 7/1967 Kandel
3,415,420 A 12/1968 White
3,457,921 A * 7/1969 Waldeisen ..... 604/130
3,528,662 A * 9/1970 Engle et al. ..... 473/577
3,565,435 A * 2/1971 Bear ..... 473/581
3,701,533 A * 10/1972 Palmer ..... 473/577
3,893,866 A * 7/1975 Hollingsworth ..... 473/581
4,257,188 A 3/1981 Barker
4,726,584 A * 2/1988 Bishop ..... 473/577
4,735,612 A * 4/1988 Chevalier ..... 604/130
4,743,030 A 5/1988 Auer et al.
4,863,428 A * 9/1989 Chevalier ..... 604/130
4,881,743 A * 11/1989 Fiorenzo ..... 473/577
5,074,437 A 12/1991 D'Andrade et al.
5,123,657 A * 6/1992 Colt et al. ..... 473/577
5,202,533 A * 4/1993 Vandersteen ..... 102/512
5,241,944 A * 9/1993 Rappaport ..... 124/67
5,377,656 A * 1/1995 Lewinski et al. ..... 124/65
5,381,928 A * 1/1995 Lee et al. ..... 222/79
5,448,984 A * 9/1995 Brovelli ..... 124/69
5,626,343 A * 5/1997 Sanders ..... 273/349
5,730,321 A * 3/1998 McAllister et al. ..... 222/1
5,826,879 A * 10/1998 Spector ..... 273/349
5,836,842 A * 11/1998 McLearan ..... 473/581

(Continued)

*Primary Examiner* — Gene Kim
*Assistant Examiner* — Alexander Niconovich
(74) *Attorney, Agent, or Firm* — Blakely Sokoloff Taylor & Zafman LLP

(57) ABSTRACT

Marker tag darts, dart guns therefor, and methods which allow a toy gun to receive a marker tag dart, to put water in the forward tip of the dart and to shoot the dart. The marker tag dart itself has slits in the wall of a small chamber at the front of the dart so that on impact with a target, the inertia of the water causes deformation of the tip and opening of the slits to eject water for marking the location of the marker tag dart hit. The dart guns are spring chocked, and propel the dart with a blast of air from an air pump powered by the spring. Various embodiments and modes of operation are disclosed.

13 Claims, 7 Drawing Sheets

(56) References Cited

U.S. PATENT DOCUMENTS

| | | | | |
|---|---|---|---|---|
| 6,146,292 | A * | 11/2000 | Yamanaka | 473/569 |
| 6,149,488 | A * | 11/2000 | Stark | 446/220 |
| 6,174,251 | B1 * | 1/2001 | Lemote | 473/581 |
| 6,203,397 | B1 * | 3/2001 | Applewhite et al. | 446/475 |
| 6,241,634 | B1 * | 6/2001 | Armer, Jr. | 473/581 |
| 6,247,995 | B1 * | 6/2001 | Bryan | 446/473 |
| 6,450,905 | B1 * | 9/2002 | Edlund | 473/581 |
| 7,185,787 | B2 * | 3/2007 | Brown et al. | 222/79 |
| 7,219,817 | B2 * | 5/2007 | Panzarella | 222/386 |
| 7,267,118 | B2 * | 9/2007 | Eddins et al. | 124/63 |
| 7,488,267 | B2 * | 2/2009 | Hunt | 473/581 |
| 7,601,084 | B2 * | 10/2009 | Martin | 473/578 |
| 7,731,612 | B2 * | 6/2010 | Martin | 473/581 |
| 8,074,838 | B1 * | 12/2011 | Tate | 222/79 |
| 2007/0012720 | A1 | 1/2007 | Rosenblum | |
| 2009/0064919 | A1 | 3/2009 | Greenwald | |
| 2009/0127789 | A1 * | 5/2009 | Andersen | 273/349 |
| 2009/0140493 | A1 * | 6/2009 | Andersen | 273/349 |
| 2010/0031945 | A1 * | 2/2010 | Shaffer et al. | 124/86 |
| 2012/0153036 | A1 * | 6/2012 | Pierce et al. | 239/6 |

* cited by examiner

MARKER TAG DARTS, DART GUNS THEREFOR, AND METHODS

BACKGROUND OF THE INVENTION

1. Field of the Invention

The present invention relates to the field of toy marker darts and water guns therefor.

2. Prior Art

Water guns and dart guns are well known in the prior art. See for instance U.S. Pat. Nos. 3,190,654, 3,330,561, 3,415,420, 3,528,662 4,257,188 4,743,030, 5,074,437, 5,241,944, 5,377,656, 5,381,928, 5,448,984, 5,626,343, 5,730,321, 5,826,879, 6,149,488, 6,203,397, 6,247,995, 7,185,787 and 7,267,118 and U.S. Patent Application Publication Nos. 2007/0012720, 2009/0064919, 2009/0127789 and 2009/0140493. However the present invention incorporates features not found in the prior art.

DETAILED DESCRIPTION OF THE PREFERRED EMBODIMENTS

Figure 1D:
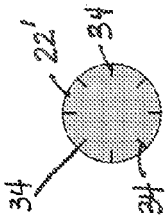
FIGS. 1*a* through 1*d* illustrate one embodiment of a marker tag dart in accordance with the present invention.
Figure 1A:
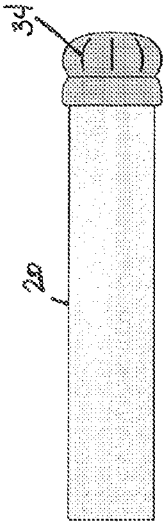
Figure 1B:
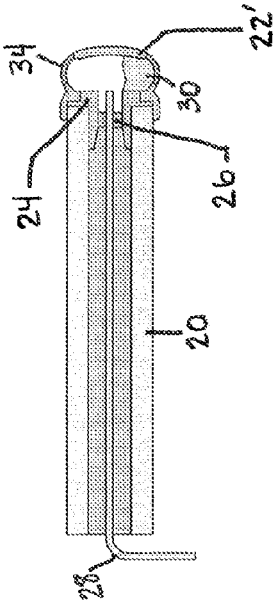
Figure 1C:
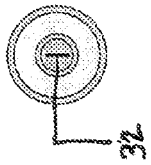

First referring to FIGS. 1*a* through 1*d*, one embodiment of a marker tag dart in accordance with the present invention may be seen. FIG. 1*a* is a side view of this embodiment, with FIG. 1*b* being a cross section of the dart and FIG. 1*d* being a front view of the dart of FIG. 1*a* illustrating one technique for injection of water into the forward end of the dart. The main dart body 20 is a tubular flexible foam member, preferably a closed cell urethane foam or similar material. At the forward end of the dart is a flexible rubber cap 22, such as a molded silicon rubber cap, which mounts to the forward end of the body 20 with a rubber plug 24 therein. The flexible rubber cap 22 in this embodiment is somewhat thicker at the front than at the sides, and defines a chamber therein. A center plug 26, which may be a separate piece or integral with the rubber plug 24, has a central slit therein which will allow a needle, such as needle 28, to poke through the slit to inject a quantity of water 30 therein, as to be subsequently described. The center rubber plug 26 with slit 32 therein may be seen in FIG. 1*c*. By proper selection of the material for the center plug and design of the slit, the slit will easily open to receive needle 28, though will be self closing on withdrawal of the needle to resist significant leakage of the water 30 back through the slit once needle 28 is withdrawn. The center plug 26 may have a duckbill type valve configuration which will be self sealing, particularly when the water 30 presses against the center plug 26 when the dart is propelled forward, also as shall be subsequently described.

Figure 2C:
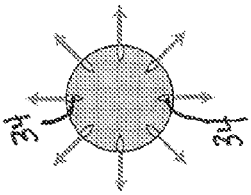
FIGS. 2*a* through 2*c* illustrate the maker tag dart of FIGS. 1*a* through 1*d* when the marker tag dart impacts an object.
Figure 2A:
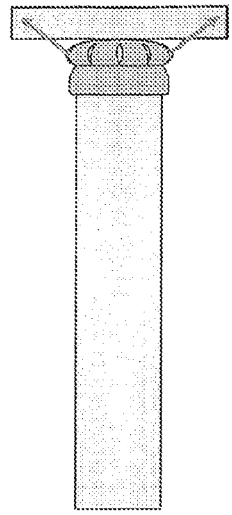
Figure 2B:
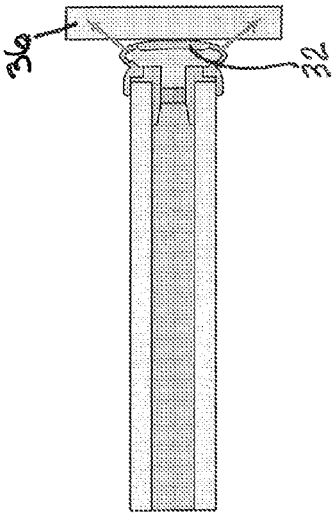

Of particular importance to the dart of FIGS. 1*a* through 1*d* are slits 34 in the rubber cap 22. These slits pass all the way through the skin of the rubber cap, though normally stay sufficiently closed when the rubber cap 22 is in its free state to contain water 30 when injected therein. However, as shown in FIGS. 2*a* through 2*c*, when the dart impacts an object 36, the rubber cap 22 deflects opening slits 34, with the inertia of the water 30 causing the water to squirt out through the slits 34 as illustrated in these Figures.

The foam body 20 is very light, and together with the fact that the center of gravity of the marker tag dart is very far forward, assures that the dart will not tumble when propelled through the air. Instead, the axis or the dart will remain aligned with its direction of travel.

Figures 3A, 3B, 3C:
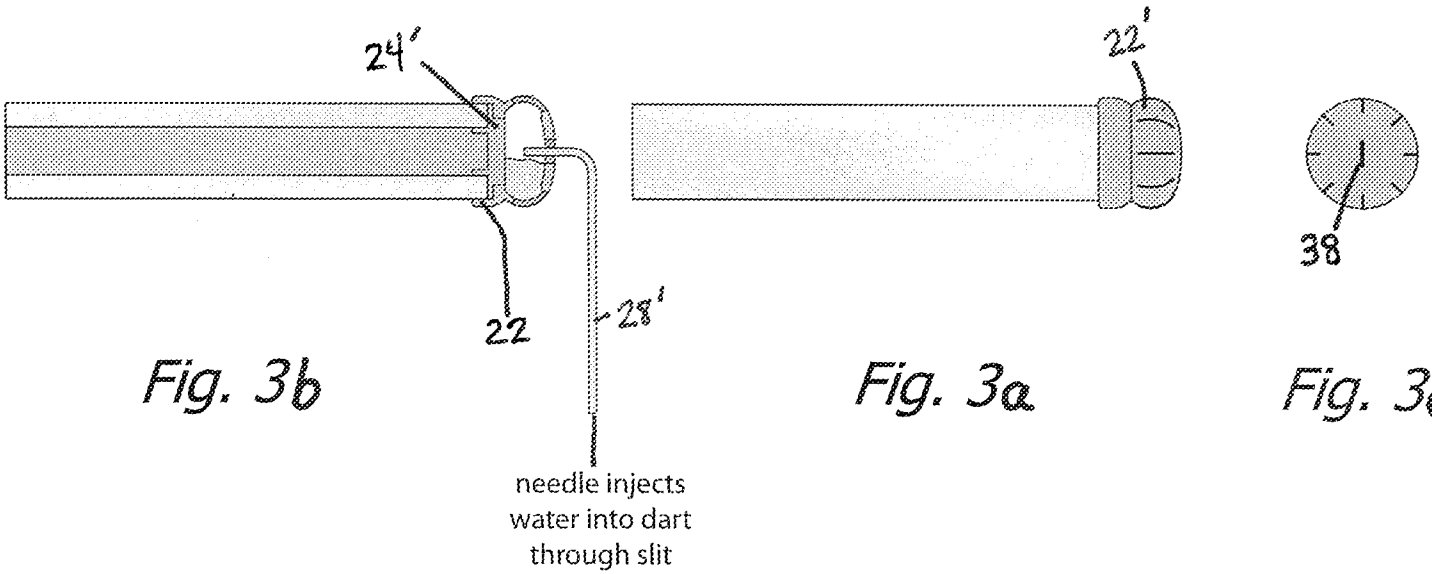
FIGS. 3*a* through 3*c* illustrate an alternate embodiment of a marker tag dart.

Now referring to FIGS. 3*a* through 3*c*, an alternate embodiment of a marker tag dart may be seen. This embodiment is nearly identical to the embodiment of FIGS. 1*a* through 1*d* and 2*a* through 2*c*, though instead of the rubber plug 24' having an integral or separate center plug, such as center plug 26 of the prior embodiment, the rubber plug 24' does not have a slit, but instead the forward end of the rubber cap 22' has a slit 38 so that a needle such as needle 28' may be used to inject water into the cavity within the rubber cap 22' from the forward end thereof. Otherwise the marker tag dart of FIGS. 3*a* through 3*c* functions the same way as the previously described embodiment.

Figure 4:
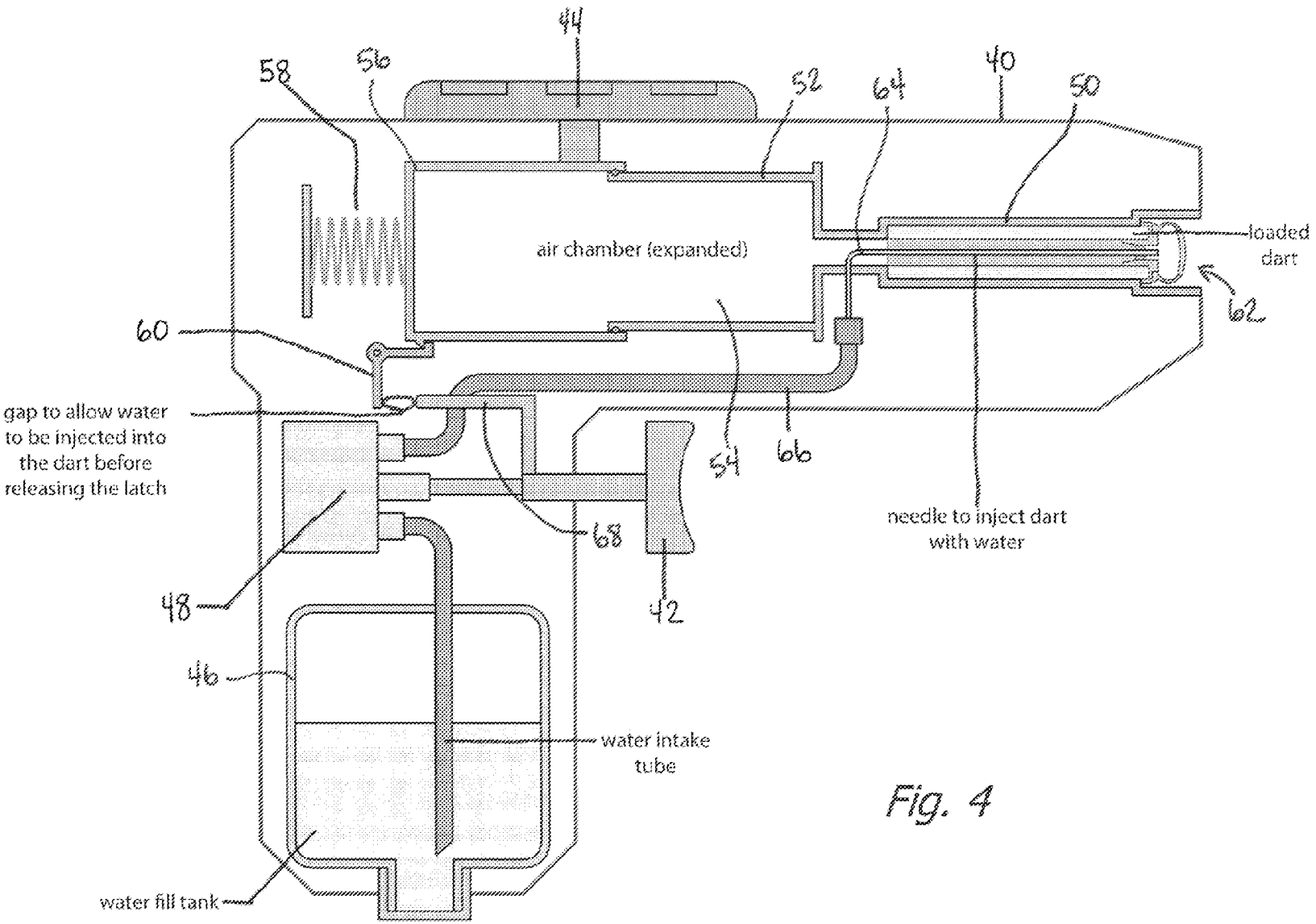
FIG. 4 illustrates a toy gun for shooting the marker tag darts of the present invention in a cocked ready to shoot state.
Figure 5:
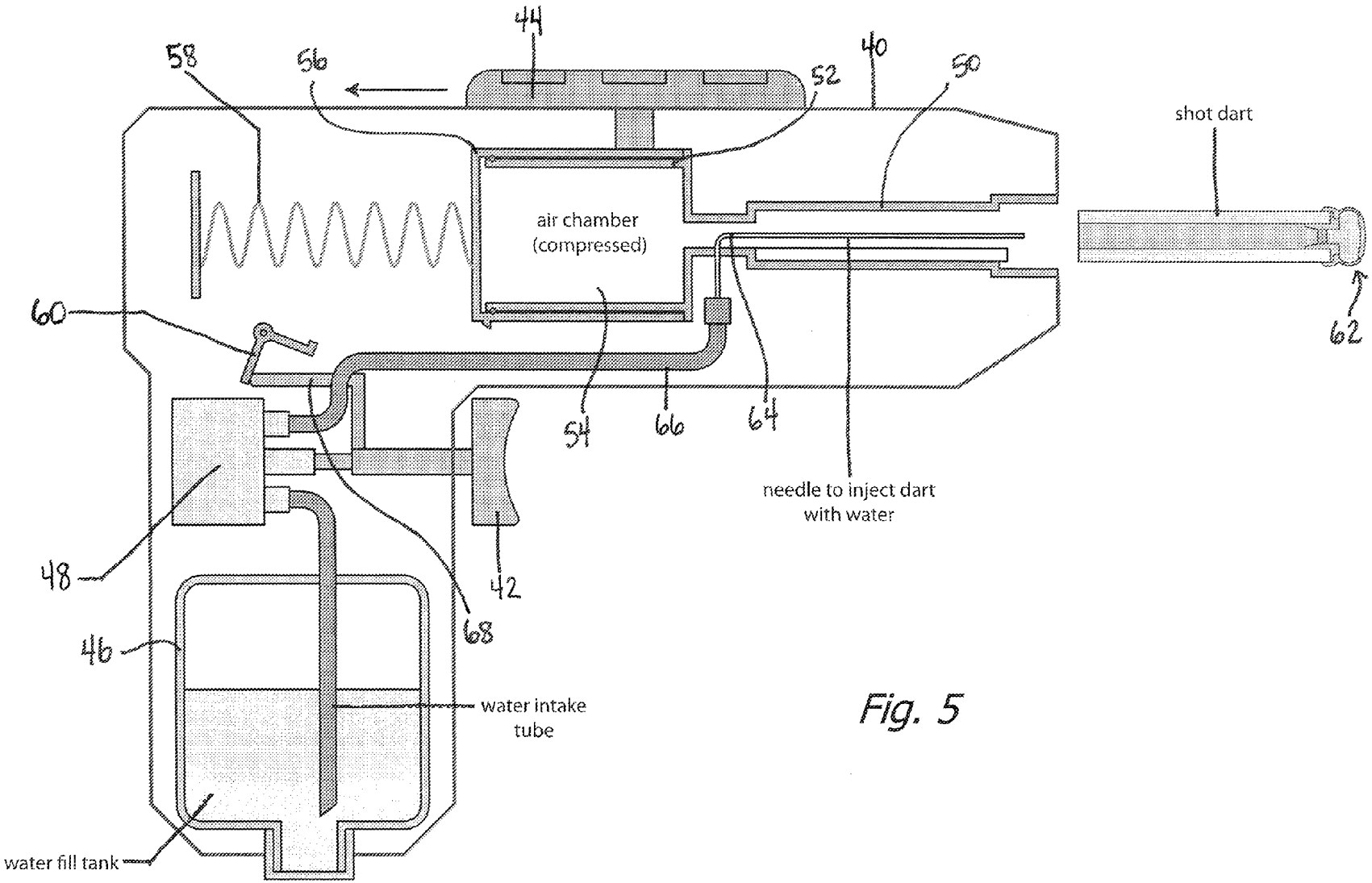
FIG. 5 illustrates the toy gun of FIG. 4 when shooting a marker tag dart of the present invention.

Now referring to FIGS. 4 and 5, a toy gun for shooting the marker tag darts of the present invention may be seen. FIG. 4 illustrates the toy handgun with a marker tag dart loaded therein and cocked to shoot the marker tag dart, and FIG. 5 illustrates the actual shooting of the marker tag dart. These Figures are somewhat schematic, though well illustrate this embodiment. The gun in outward appearance has a handgun like body 40 with a trigger 42 and an air chamber cocking mechanism 44. Internally, in the handgrip region of the handgun is a water reservoir 46, a water pump 48 powered by trigger 42 and a barrel 50 with a connected portion 52 of an air chamber 54. The rear portion of the air chamber 54 is formed by a member 56 coupled to the air chamber cocking mechanism 44 and acting against coil spring 58. A latch 60 holds the member 56 of the air chamber 54 in a rearward position when the gun is cocked and ready to shoot, as shown in FIG. 4. When the marker tag dart 62 is loaded, needle 28 (see also FIG. 1*b*) will penetrate the slit 32 (FIG. 1*c*) as shown, with the needle 28 being coupled to the water pump 48 through water output tube 66.

When the trigger 42 is pulled and the trigger starts to move to the left as shown in FIGS. 4 and 5, water is first pumped by pump 42 from the water reservoir 46 through water output tube 66 and needle 28 into the nose of the marker tag dart 62. As the trigger continues to move, member 68 will engage latch 60 as shown in FIG. 5 and release the member 56 of the air chamber 54 to allow the coil spring 58 to push the member 56 of the air chamber forward as shown in FIG. 5, sending a blast of air into the barrel to launch the marker tag dart marker tag dart 62 as shown in FIG. 5.

Figure 6:
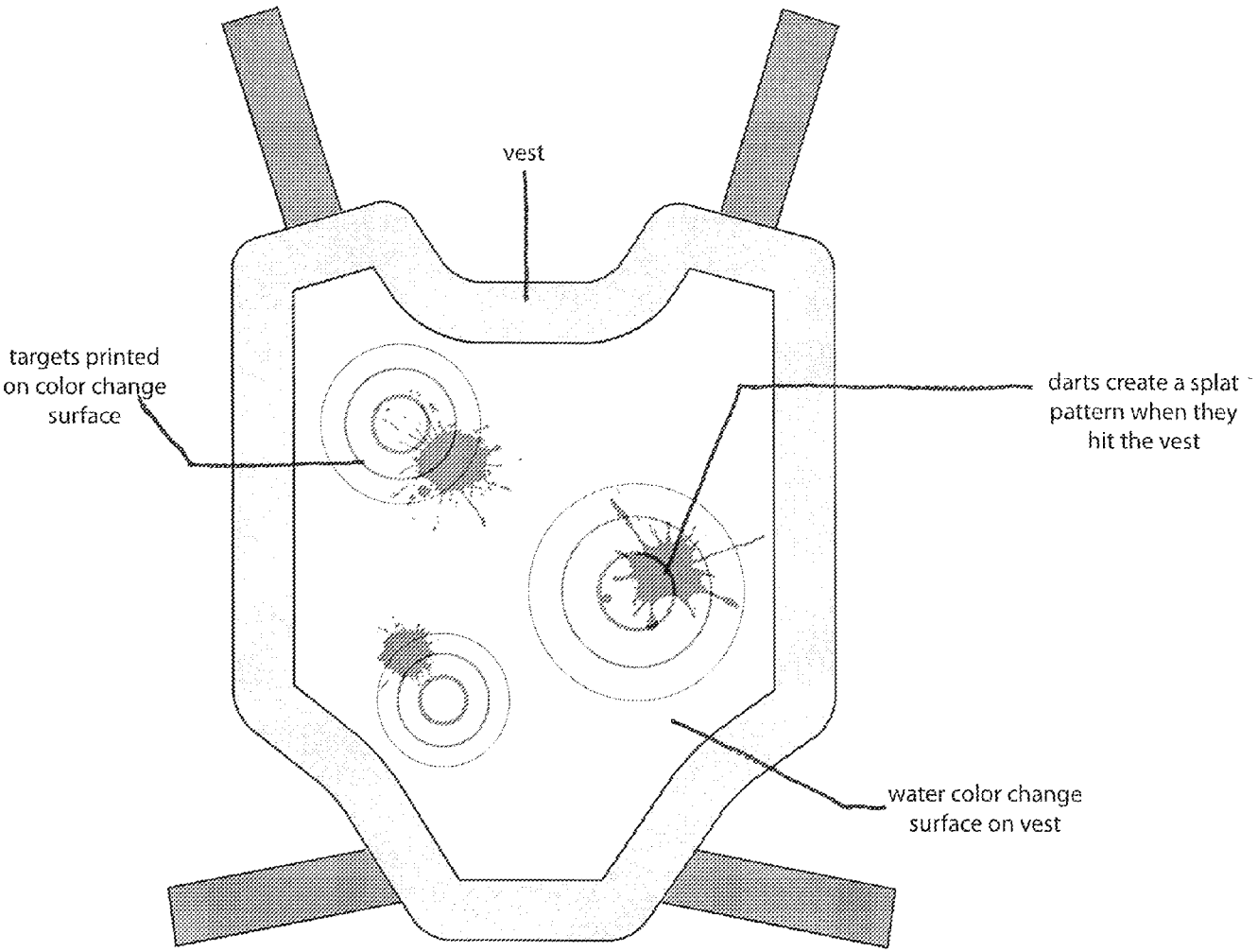
FIG. 6 illustrates an exemplary target in the form of a vest type article worn by each player in a tag type game.

In a typical use, a target may be used which changes color when wetted. In that regard, suitable hydrochromatic inks are readily commercially available. Alternatively, a target may use a thin cloth with a second layer of a different color behind the thin cloth, so that when wetted, the color of the second layer is visible through the wetted area of the thin cloth. The target might be a fixed target, or in a tag type target game, may be a vest type article worn by each player, one form of which is illustrated in FIG. 6. Alternatively, disappearing ink could be used instead of water so that no target in necessary.

Figure 7:
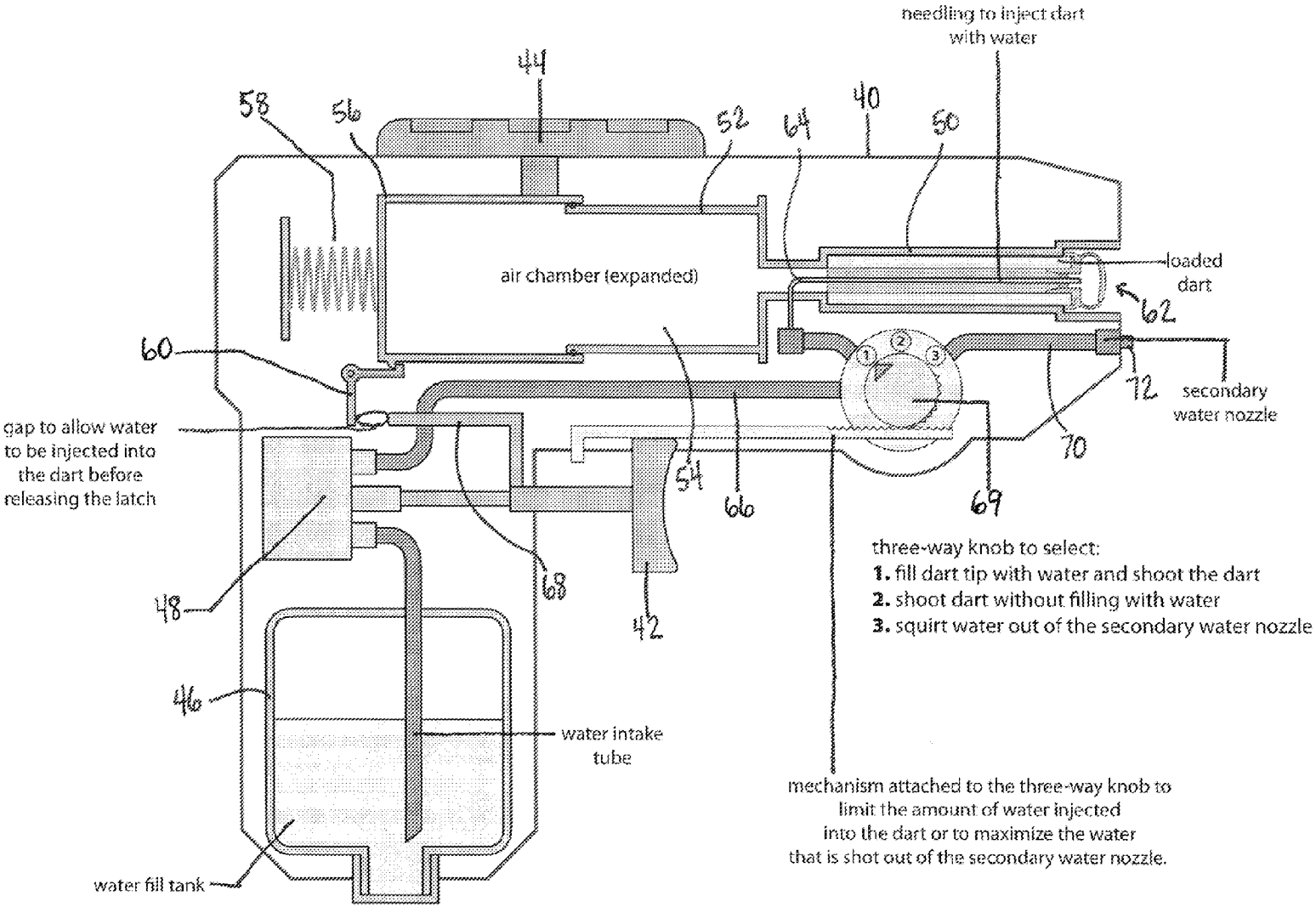
FIG. 7 illustrates an alternate embodiment of a toy gun for shooting the marker tag darts of the present invention.

Now referring to FIG. 7, an alternate embodiment of the marker tag gun may be seen. In this embodiment, the water output tube 66 does not go directly to needle 64 for loading the marker tag dart 62, but instead goes to a valve 69 which controls the flow of water in the water output tube 66. In particular, when in position 1 as shown, the water pumped by the initial pulling of the trigger is provided to the marker tag dart 62 through needle 64 prior to releasing the marker tag dart 62, as in the previously described embodiment. When valve 69 is in the second position, water flow is blocked so that the marker tag dart 62 will be released without having supplied water to its forward tip. In that regard, water pump 48 is a rather leaky pump, so that the trigger 42 can still be pulled even though water flow is blocked. When valve 69 is in the third position, water is supplied not to the tip of the marker tag 62, but rather through tube 70 to output nozzle 72 to shoot a stream of water starting just before the dart itself is released.

Figure 8:
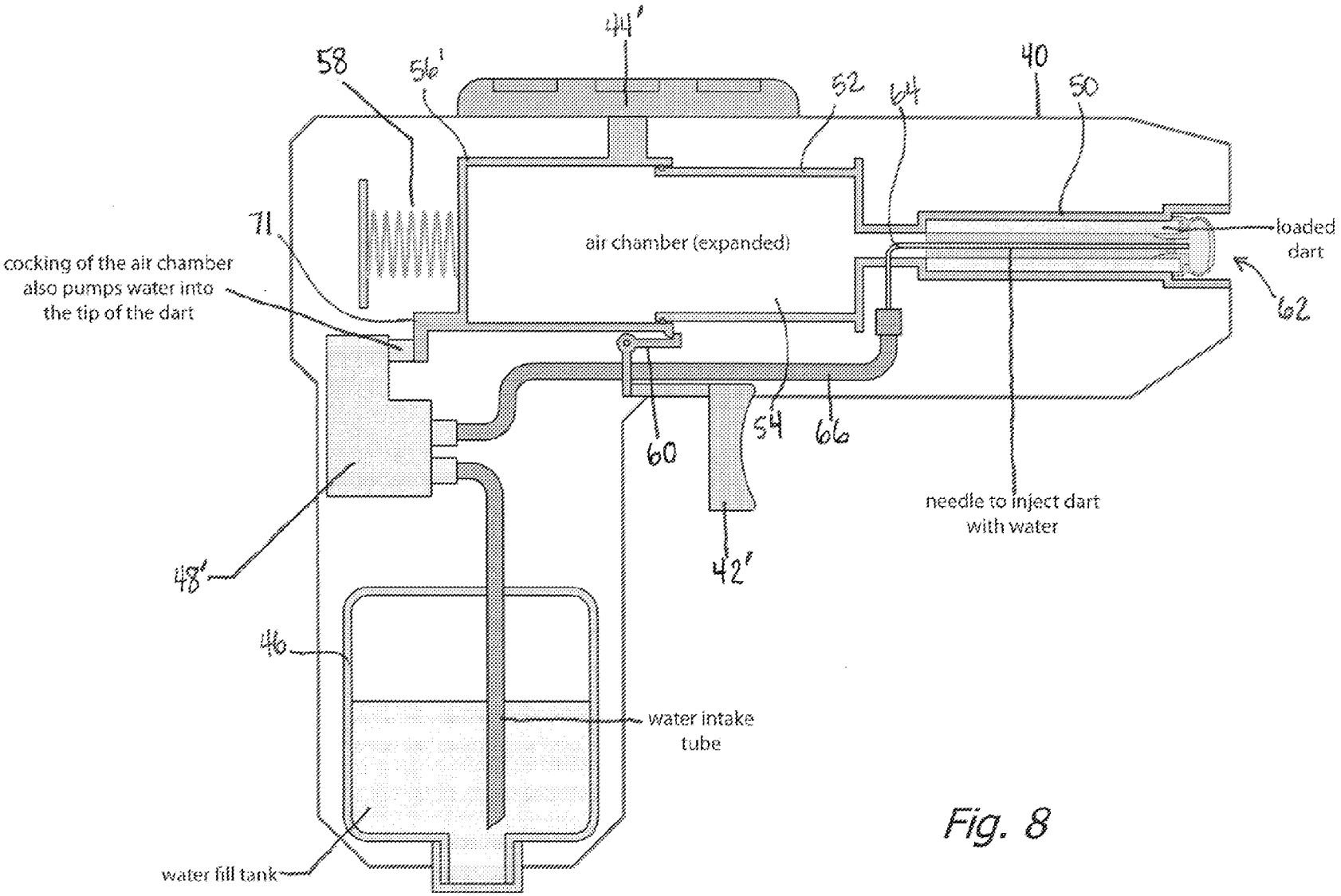
FIG. 8 illustrates a further alternate embodiment of a toy gun for shooting the marker tag darts of the present invention.

Now referring to FIG. 8, a further alternate embodiment is shown. This embodiment has a number of similarities to the prior embodiments. Accordingly, a number of parts may be identical to that of the earlier embodiments and are therefore given the same identification numerals. In some other cases, minor variations in the parts and/or their function have been made, and in such instances, such parts have been given the same identification numerals as the earlier embodiments, though followed by a prime to indicate some differences. By way of example, pump 48 in FIGS. 4, 5 and 7 is labeled pump 48' in the embodiment of FIG. 8 because of a minor variation thereof. The main difference in the embodiment of FIG. 8 is that pump 48' is actuated by a rear tab 71 on member 56'. In particular, pump 48' is actuated when the gun is cocked by pulling back on the cocking mechanism 44' until latch 60 engages the forward part of member 56' to hold the same in the cocked position against the force of spring 58. During this cocking motion, the rear tab 71 engages the water pump 48' to put water in the dart 62 through needle 64 and water output tube 66. Thus on pulling the trigger 42', the cocking mechanism is immediately released to fire the marker tag dart as before. The advantage of this embodiment is that the marker tag dart is preloaded with water so that no further water is ejected through needle 64 after the marker tag dart is launched, thereby avoiding any slight further water discharge of the earlier described embodiments because of some continued travel of the trigger pumping such additional water.

Thus the present invention has a number of aspects, which aspects may be practiced alone or in various combinations or sub-combinations, as desired. While certain preferred embodiments of the present invention have been disclosed and described herein for purposes of illustration and not for purposes of limitation, it will be understood by those skilled in the art that various changes in form and detail may be made therein without departing from the spirit and scope of the invention as defined by the full breadth of the following claims.

What is claimed is:

1. A marker tag dart for use in a marker tag dart gun comprising:

a foam marker tag dart body;

an elastic cap attached to a one end of the foam marker tag dart body;

the elastic cap defining, at least in part, a chamber therein;

the elastic cap having a substantially self sealing area for temporary penetration for injection of a liquid into the chamber;

the elastic cap also having a plurality of irregularities in a forward end of the cap opposite the foam marker tag dart body, the irregularities configured to retain liquid in the chamber when the elastic cap is not elastically deformed, and to release liquid in the chamber when the forward end of the cap impacts an object;

the elastic cap again being able to retain liquid in the chamber when the elastic cap is again not elastically deformed;

whereby after one impact, the marker tag dart may be ready for reuse by replacing the liquid released during the prior impact.

2. The marker tag dart of claim 1 wherein the irregularities comprise a plurality of slits in the forward end of the elastic cap.

3. The marker tag dart of claim 1 wherein the self sealing area on the elastic cap is on the forward end thereof.

4. The marker tag dart of claim 1 wherein the self sealing area on the elastic cap is located opposite the forward end thereof, and is accessible through the foam body.

5. The marker tag dart of claim 1 wherein the marker tag dart body has a substantially constant outer diameter along its length substantially equal to a diameter of the elastic cap.

6. The marker tag dart of claim 1 wherein the marker tag dart body is a closed cell urethane foam body.

7. The marker tag dart of claim 1 wherein the marker tag dart body has a substantially constant inner diameter along its length.

8. A marker tag dart for use in a marker tag dart gun comprising:

a foam marker tag dart body, the marker tag dart body being tubular with substantially uniform inner and outer diameters along its length and having a diameter approximately equal to a diameter of an elastic cap;

the elastic cap being attached to one end of the foam marker tag dart body;

the elastic cap, at least in part, defining a chamber therein;

the elastic cap having a substantially self sealing area for temporary penetration for injection of a liquid into the chamber;

the elastic cap also having a plurality of slits in a forward end of the cap opposite the foam marker tag dart body, the slits being configured to retain liquid in the chamber when the elastic cap is not deformed, and to release liquid in the chamber when the forward end of the cap impacts an object and deflects;

the elastic cap again being able to retain liquid in the chamber when the elastic cap is again not elastically deformed;

whereby after one impact the marker tag dart may be ready for reuse by replacing the liquid released during the prior impact.

9. The marker tag dart of claim 8 wherein the self sealing area on the elastic cap is on the forward end thereof.

10. The marker tag dart of claim 8 wherein the self sealing area on the elastic cap is located opposite the forward end thereof, and is accessible through the foam body.

11. The marker tag dart of claim 8 wherein the marker tag dart body is a closed cell urethane foam marker tag dart body.

12. The marker tag dart of claim 1 wherein the self sealing area on the elastic cap is located opposite the forward end thereof, and is accessible through the foam body, and further comprising:

a storage volume for storing a supply of liquid;

a pump coupled to the storage volume, an outlet of the pump being coupled to a needle for temporary penetration of the substantially self sealing area for injecting the liquid into the chamber in a marker tag dart;

whereby the liquid may be pumped into the chamber in the marker tag dart prior to launching the marker tag dart toward the object, and the needle will be withdrawn from the self sealing area when the marker tag dart is launched.

13. The marker tag dart of claim 8 wherein the self sealing area on the elastic cap is located opposite the forward end thereof, and is accessible through the foam body, and further comprising:

a storage volume for storing a supply of liquid;

a pump coupled to the storage volume, an outlet of the pump being coupled to a needle for temporary penetration of the substantially self sealing area for injecting the liquid into the chamber in a marker tag dart;

whereby the liquid may be pumped into the chamber in the marker tag dart prior to launching the marker tag dart toward the object, and the needle will be withdrawn from the self sealing area when the marker tag dart is launched.

* * * * *